United States Patent [19]

Herpich et al.

[11] 4,029,224

[45] June 14, 1977

[54] TAILGATE FOR A REAR LOADING REFUSE VEHICLE

[75] Inventors: William A. Herpich; George W. Palmer, both of Galion; Francis H. Pittenger, Shelby, all of Ohio

[73] Assignee: Peabody International Corporation, Galion, Ohio

[22] Filed: May 24, 1976

[21] Appl. No.: 689,082

[52] U.S. Cl. ..... 214/83.3

[51] Int. Cl.[2] ..... B65F 3/00

[58] Field of Search ..... 214/83.3, 503; 100/233

[56] References Cited

UNITED STATES PATENTS

| | | | |
|---|---|---|---|
| 3,746,192 | 7/1973 | Herpich et al. | 214/83.3 |
| 3,767,068 | 10/1973 | Herpich et al. | 214/83.3 |

*Primary Examiner*—Robert G. Sheridan
*Attorney, Agent, or Firm*—Henry K. Leonard

[57] ABSTRACT

A tailgate for a rear loading refuse vehicle. The tailgate has vertical side walls and a hopper-like bottom. There is an upwardly and forwardly inclined guide track in each of the side walls. A slide block is reciprocated in each guide track by one of a pair of packing cylinders which extend along and are spaced laterally from the guide tracks with the bases of the cylinders at the upper ends of the tracks and the ends of their rods connected to the slide blocks. A generally rectangular packer blade is pivotally supported along its upper edge by the guide blocks. A pair of sweep cylinders are pivotally connected at the upper rear corner of the tailgate and their rods are pivotally connected to the packer blade at a point intermediate its upper and lower edges. The geometry of the apparatus is such as to apply the force acting laterally on the guide tracks primarily in the down direction so that the tailgate structure is supported against this force by the vehicle body enabling the tailgate sidewalls to be less massive. Preferably the guide tracks open toward the inside of the tailgate and the packing cylinders are located inside the tailgate. A non-load carrying fall back shield also is carried by the slide blocks to prevent refuse already in the vehicle body from falling backwardly over the packer blade.

15 Claims, 11 Drawing Figures

5
29
20
23
38
40
21
22
37
36
30
7
42
43
5
46
48
45
41
32
7
47
25
26
24

3,615,029

3,746,192

TAILGATE FOR A REAR LOADING REFUSE VEHICLE

BACKGROUND OF THE INVENTION

Many different types of rear loading refuse vehicles have been suggested and several different general types of mechanisms for actuating their packer blades in order to move refuse from the hopper-like bottoms of their tail gates into their bodies, have been disclosed in the patented art.

For examples, in each of the U.S. Pat. Nos. to Appleman et al 3,615,028 and 3,615,029 the tail gate has upwardly and forwardly inclined, linear guide tracks in its sidewalls and a transversely extending, massive carrier plate which slides in the guide tracks. The packer blade is pivotally mounted along its upper edge to the rear or lower edge of the carrier plate. The carrier plate also carries hydraulic cylinders which may be called "sweep cylinders" and which have pistons that are connected to the packer blade in order to swing it angularly relative to the carrier plate for sweeping the packer blade down into the refuse in the collecting hopper. The carrier plate is reciprocated in the guide tracks by hydraulic cylinders and pistons which are mounted on the exteriors of the sidewalls of the tail gate and are actuated to move the carrier plate and the packer blade upwardly and forwardly to move the refuse out of the tail gate into the refuse truck body. The base parts of the cylinders are positioned at the lower rear ends of the guide tracks and their piston rods extend upwardly and are connected to the carrier plate. The rods are extended to move the refuse out of the tail gate into the body and may be called "packing cylinders".

Arrangements like these have several problems including the fact that the carrier plate must be heavy enough to transport the hydraulic cylinders which sweep the packer blade down into the refuse receiving hopper at the rear of the tail gate, that movement being strongly resisted by the refuse in the hopper. In addition, the external cylinders are so located that the travel of the carrier plate and the packer blade downwardly and rearwardly is limited by the fact that the bodies of the cylinders are at the lower rear of the tail gate so that the outer ends of their piston rods can retract only to the upper ends of the cylinders. This also results in reduced ground clearance to achieve the same packer blade travel in the guide tracks and the same hopper capacity.

In addition, after the sweep cylinders have swung the packer blade down into the hopper, the assembly comprising the carrier plate and the packer blade becomes a rigid structure which must be pushed upwardly by the packing cylinders. At this point, the load of the refuse in the hopper which resists the packing movement is applied to the packer blade and the force applied by the packing cylinders to the carrier plate results in very heavy "up-truck" loading. If the packing cylinders are not aligned with the carrier plate guide tracks but are spaced above them, as in Anderson U.S. Pat. No. 3,615,029, the lever arm for the force of the packing cylinders is even greater. As a result, the guide tracks in such an arrangement must be very strong and much of the power of the packing cylinders is wasted.

A structure of the type shown in U.S. Pat. Nos. 3,746,192 and 3,777,917 both to Herpich et al, overcomes some of these difficulties by connecting the sweep cylinders between the upper rear portions of the tail gate and the packer blade itself. This eliminates the necessity for a carrier plate. The packer blade in such a construction is pivotally carried by slide blocks which travel in the inclined tracks. However, even though the construction of these patents eliminates the heavy carrier plate, the external, linearly acting hydraulic cylinders and rods still are limited by the location of the cylinders at the lower parts of the tracks. The geometry results in putting a heavy "down-load" on the tracks themselves when the packing cylinders are energized to move the packer blades for pushing a load of refuse upwardly and forwardly out of the hopper and into the refuse truck body. Again, the tracks must be very strong and some of the power of the packing cylinders is wasted.

It is, therefore, the principal object of the instant invention to provide a packer blade actuating mechanism for a tail gate for a rear loading truck that is not limited to the extent to which such mechanisms are limited in the constructions of the prior art discussed above.

Yet another object of the instant invention is to provide a mechanism for actuating the packer blade of a rear loading refuse vehicle which, by reason of its geometry, introduces balancing forces acting both toward the upper and lower sides of the guide tracks, partially offsetting each other and resulting in a net lower track loading, even though the cylinders exert force equal to that exerted by the cylinders of the above described prior art arrangements.

It is yet another object of the instant invention to provide a mechanism for the actuation of a packer blade in the tail gate of a rear loading refuse vehicle having linearly extending, upwardly and forwardly inclined guide tracks to guide the travel of the packer blade, so constructed and arranged that the guide tracks open toward the inner sides of the tail gate, the packing cylinders are located interiorly of the tail gate, their inclination relative to the guide tracks may be selected to accomplish substantial reduction in the track loading forces involved and greater ground clearance may be achieved while providing a loading hopper of a capacity comparable to that of prior art constructions or greater.

Yet another object of the instant invention is to provide a mechanism for cycling a packer blade through the tailgate of a rear loading refuse vehicle which reduces wear and destructive forces on the tailgate structure itself by transferring part of the forces to the vehicle body so that the tailgate structure may be constructed from less massive materials, reducing its cost and its dead weight.

DESCRIPTION OF PREFERRED EMBODIMENT

Figure 1:
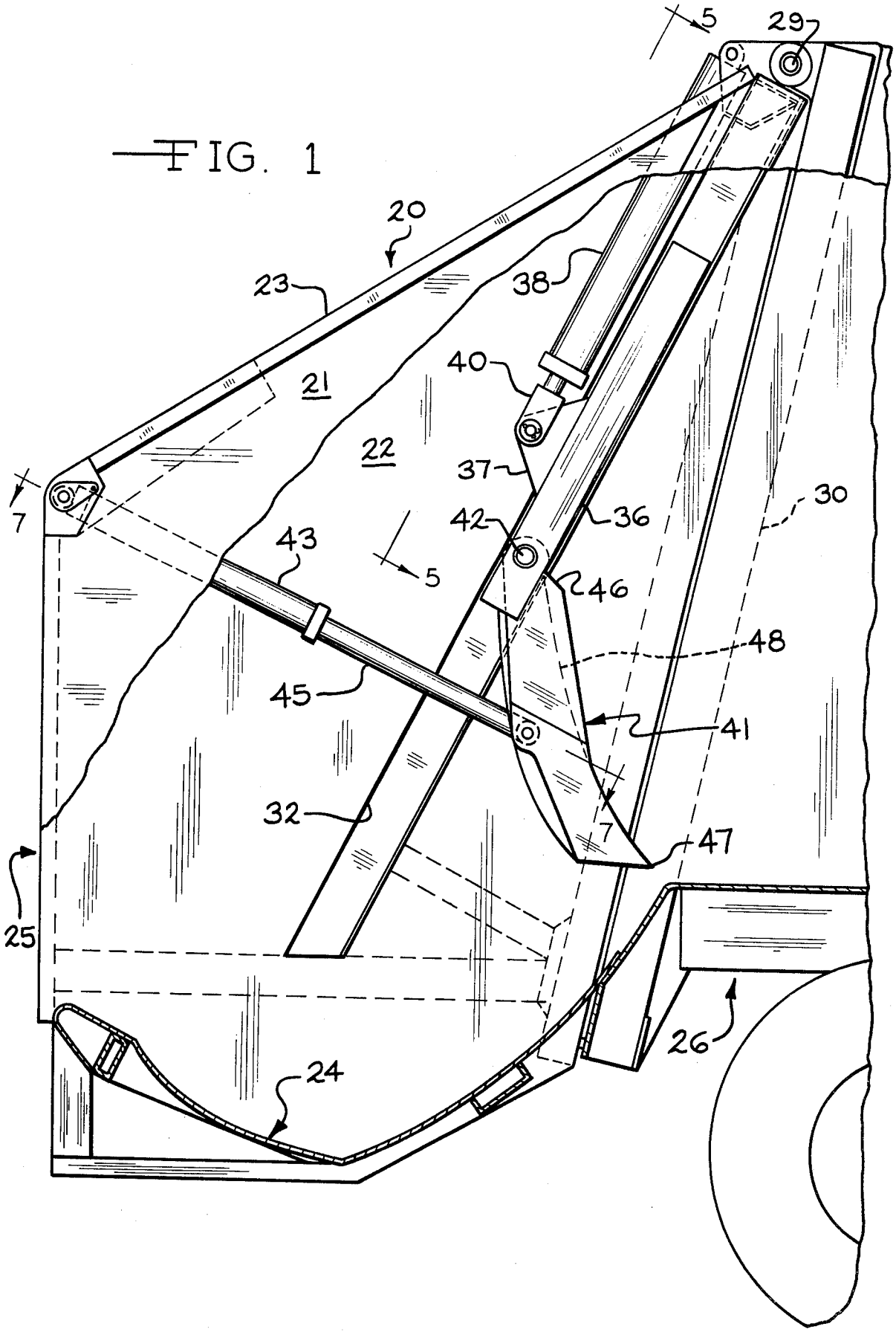
FIG. 1 is a fragmentary view, partly in side elevation and partly in vertical section, of a tail gate for a rear loading refuse truck comprising packer blade actuating mechanism embodying the invention.
Figure 2:
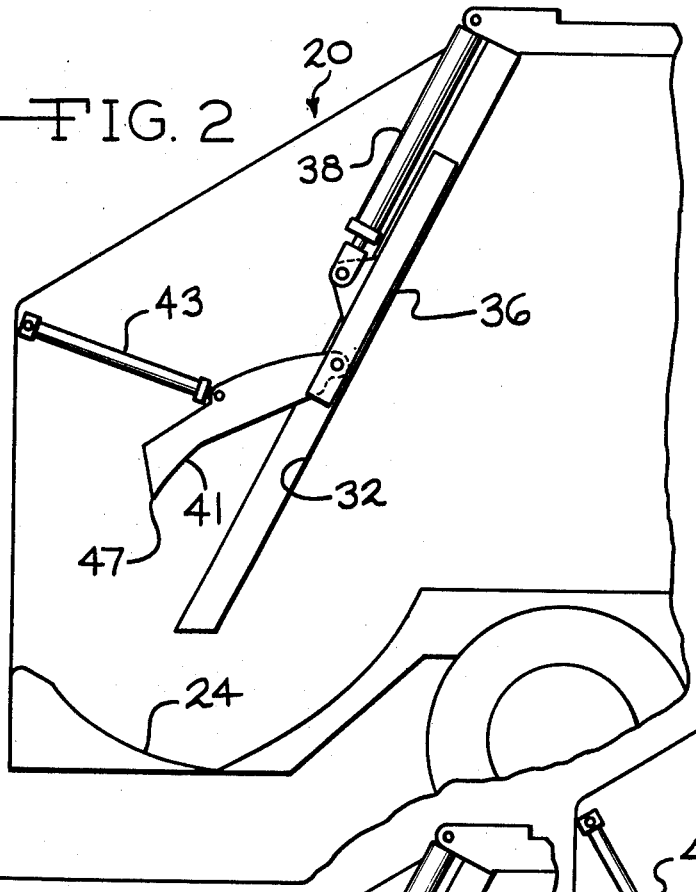
FIGS. 2, 3 and 4 are simplified views similar to FIG. 1 but showing less detail and illustrating the sequential positions of the packer blade and its actuating invention during a cycle, being shown on a smaller scale.

A tail gate, generally indicated by the reference number 20 has vertical side walls, 21 and 22, a roof 23, and a hopper-like bottom 24. The side walls 21 and 22 and the bottom 24 define a rear opening, generally indicated by the reference number 25, through which refuse is dumped into the bottom 24.

The tail gate 20 is mounted at the rear of a body 26 of a refuse vehicle, the vehicle being only fragmentarily shown in the FIGS. 1–4, inclusive. While the mounting of the tail gate 20 on the vehicle body 26 is generally similar to such arrangements of the prior art, it should be noted that the hinge means by which the tail gate is mounted comprises a massive rearwardly extending hinge plate 27 on the body at each side of the tail gate 20 and a similarly massive hinge plate 28 structurally rigid with the tail gate at each of its upper front corners. The two hinge plates 27 and 28 on each side are connected to each other by a heavy hinge pin 29. The rear opening of the refuse vehicle body 26 is defined by heavy frame members 30 and the front side of the tail gate 20 is similarly defined by heavy frame members 31.

Each of the side walls 21 and 22 has an upwardly and forwardly inclined guide track 32 (See also FIGS. 6 and 7), each guide track 32 having an upper surface 33, a lower surface 34, and an outer closed side 35. In the illustrated embodiment of the invention an elongated, generally rectangular slide block 36 is mounted to reciprocate in each of the guide tracks 32. Each of the slide blocks 36 has a structurally integral arm 37 welded or otherwise rigidly attached to the inner side of the respective slide block 36 and the extending upwardly and rearwardly therefrom. A packing cylinder 38 is pivotally mounted at its upper end on the hingeplate 28 at each side of the tail gate 20 and the respective rods 39 of the cylinders 38 are connected by clevises 40 to the associated ones of the arms 37.

A packer blade 41 of generally rectangular shape extends across the tail gate 20 and is pivotally carried on a cross rod 42 the ends of which are mounted in the lower ends of the slide blocks 36 so that the packer blade 41 pivots round the rod 42 during its cycle through the tail gate 20.

Sweep cylinders 43 (See also FIG. 7) are pivotally mounted at their base ends between sets of heavy gusset plates 44 that are located at the upper rear corners of the tail gate 20, there being one cylinder 43 at each side of the tail gate 20. Rods 45 of the cylinders 43 are pivotally connected to the packer blade 41 at a position generally intermediate its upper edge 46 and its lower edge 47.

By alternate actuation of the sweep cylinders 43 and the packing cylinders 38, the packer blade 41 is moved through an excursion in each packing cycle. FIG. 1 shows the packing blade 41 at its most forward position where it closes off the lower portion of the body 26 to prevent refuse already in the body 26 from falling backwardly and down into the hopper bottom 24. When the control mechanism is cycled, the sweep cylinders 43 first are energized to retract their rods 45 and to swing the packer blades 41 from the position shown in FIG. 1 to the position shown in FIG. 2. This elevates the lower edge 47 above the level of any refuse which has been dumped into the hopper bottom 24 and holds the packer blade 41 in its upper position. The packing cylinders 38 are then actuated to extend their rods 39, moving the slide blocks 36 downwardly along the guide tracks 32 and moving the packer blade 41 from the position shown in FIG. 2 to the positions of FIG. 3. During this movement between the positions of FIGS. 2 and 3 the sweep cylinders 43 are not actuated and merely swing on their pivots on the gusset plates 44 so that the packer blade 41 is carried rearwardly into the substantially horizontal position of FIG. 3 with its lower edge 47 above the rear portion of the hopper bottom 24.

At that point the control mechanism shifts the fluid valves so that the sweep cylinders 43 are actuated to extend their rods 45 to move the packer blade 41 downwardly with its lower edge 47 sweeping along the surface of the rear portion of the arcuately shaped hopper bottom 24 and, by reason of this movement, preliminarily compacting refuse in the hopper bottom 24.

Figure 4:
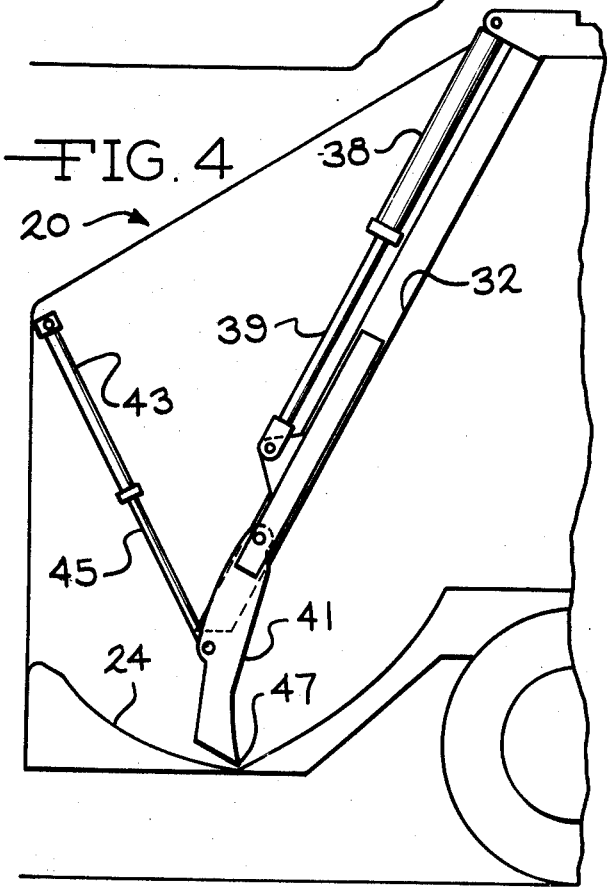

When the packer blade 41 reaches the position of FIG. 4, the hydraulic controls are so designed as to readmit fluid to the packing cylinders 38 causing them to retract their rods 39 moving the slide blocks 36 up the guide tracks 32 and pulling the packer blade 41 forwardly and upwardly to move the refuse accumulated ahead of it into the body of the refuse vehicle, the mechanism coming to a stop when the parts are once again in the position of FIG. 1.

Figure 3:
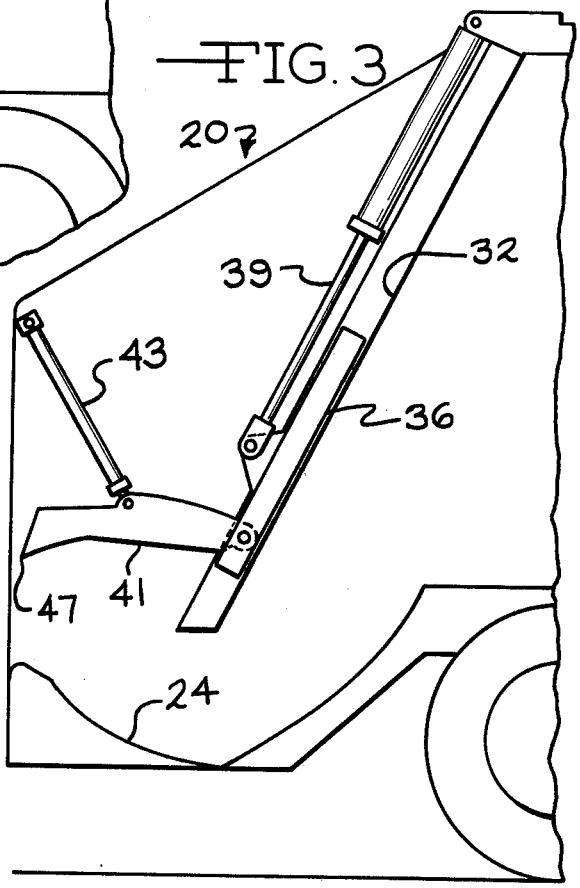

As can best be seen in FIG. 1, the packer blade 41 has a concave face 48 which imparts to the refuse ahead of the packer blade 41 a rolling and compacting action during the movement from the position of FIG. 3 to the position of FIG. 4 and from the position of FIG. 4 to position of FIG. 1. However, of course, the particular configuration of the face of the packer blade 41 is not a part of the instant invention and is merely illustrated as being effective.

Figure 5:
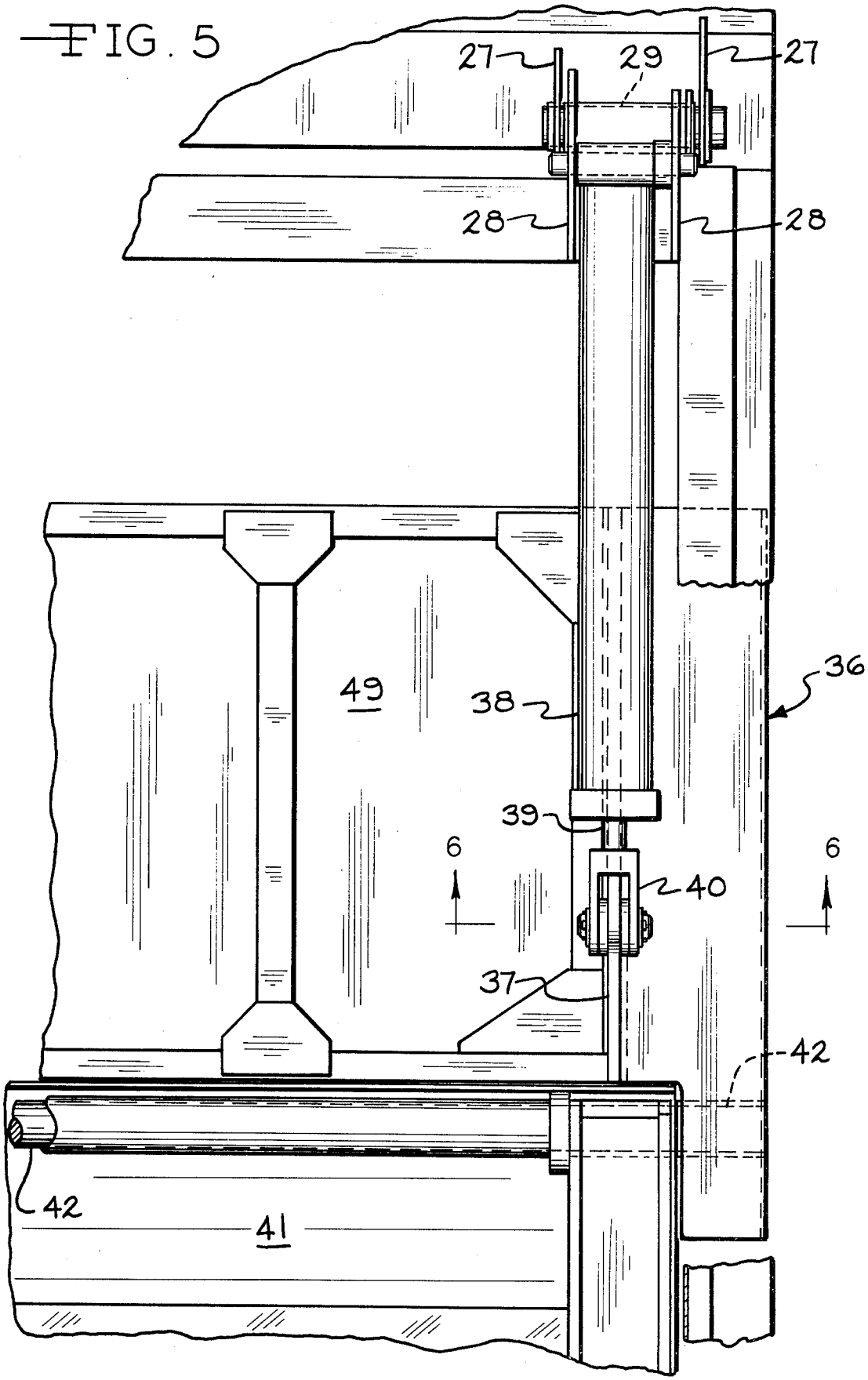
FIG. 5 is a fragmentary view in elevation taken approximately from the position indicated by the Line 5—5 of FIG. 1 with the cover for the tail gate removed and shown on an enlarged scale.
Figure 6:
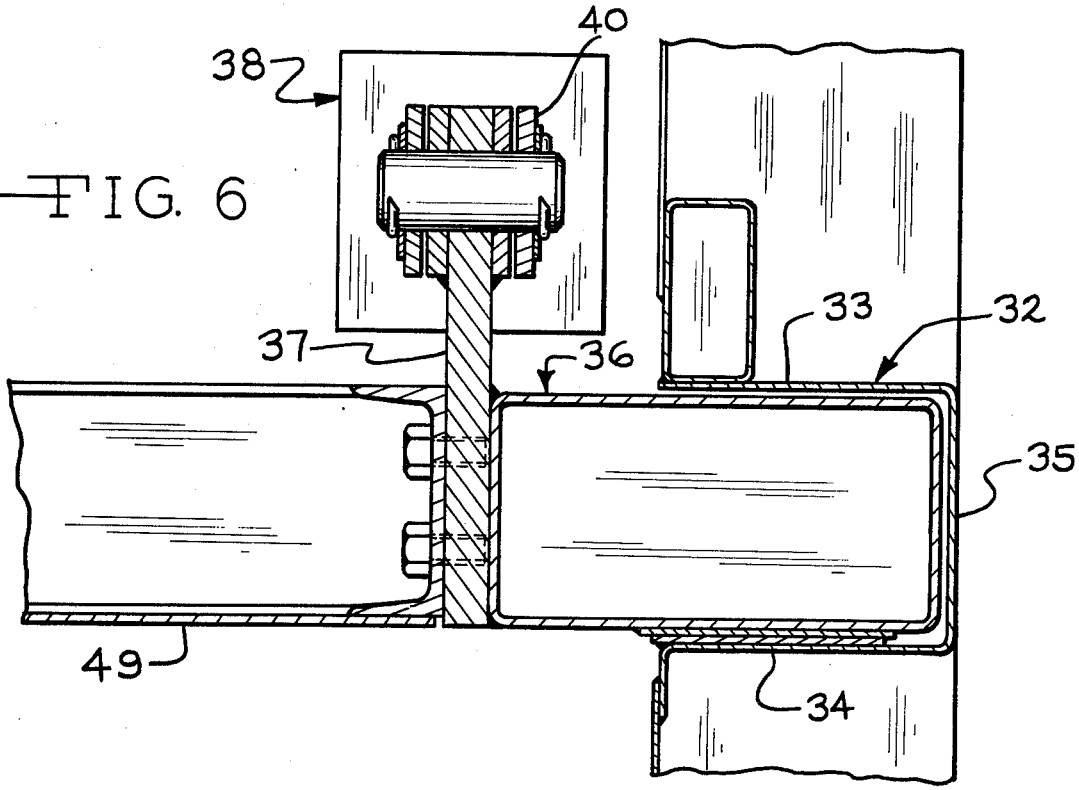
FIG. 6 is a greatly enlarged fragmentary sectional view taken along the Line 6—6 of FIG. 5.
Figure 7:
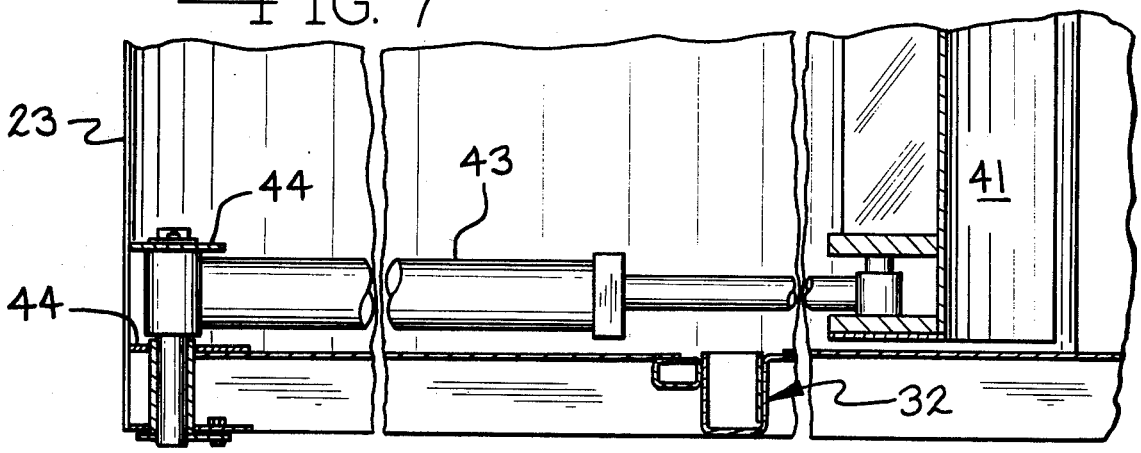
FIG. 7 is a fragmentary sectional view showing a packer blade and some of its associated mechanism according to the invention.
Figure 8:
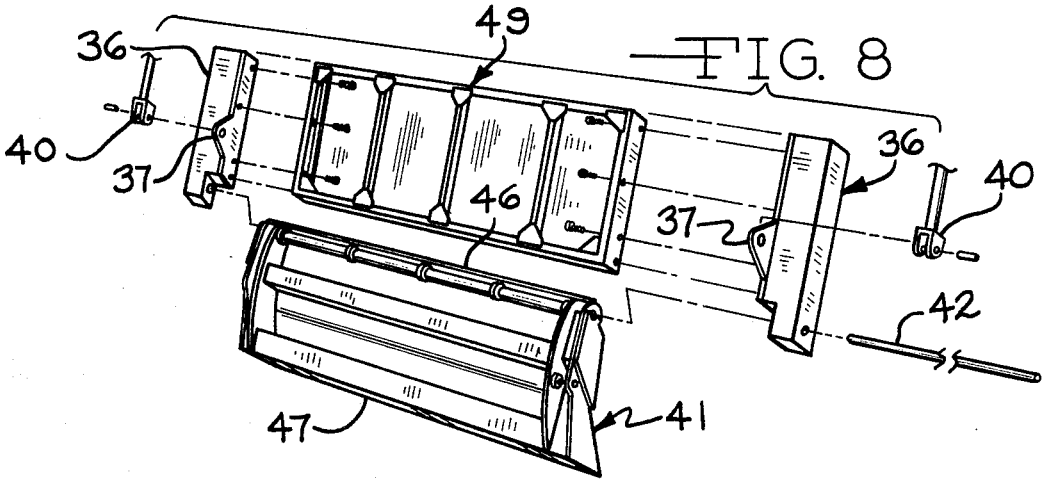
FIG. 8 is a partial, exploded view showing a packer blade and some of its associated mechanism according to the invention.

As can best be seen by reference to FIGS. 5, 6 and 8 a mechanism according to the invention also preferably is equipped with a fallback shield 49 which travels with the slide blocks 36 above and ahead of the upper edge 46 of the packer blade 41. As shown in FIG. 8, the fallback shield 49 is simply a reinforced flat sheet, for example, a steel sheet, which is bolted to the two slide blocks 36 and extends across the tail gate 20 but does not carry any of the actuating mechanism and is not essential to the operation which has been described. It will be appreciated that when the packer blade is moved from the position of FIG. 4 to the position of FIG. 1, the entry of the additional refuse into the lower portion of the vehicle body may displace some of the previously loaded refuse and, without the fallback shield 49 some of this refuse might fall backwardly over the upper edge of the packer blade 41 and tumble back down into the hopper bottom 24.

In considering the advantage of a tail gate embodying the invention and, in particular, of the specifically described mechanism for actuating its packer blade, it will be noted that the packing cylinders 38 are located interiorly of the tail gate 20. This has several advantages. Among them are protection of the cylinder 38 and its connections from damage if and when the vehicle may be struck by other vehicles or inadvertently may be backed into a building or another vehicle during its operation. In addition, by placing the packing cylinders interiorly of the tail gate 20, the hydraulic lines to the cylinders 38 are shortened and also may pass through the interiors of the refuse body 26 and tail gate 20 thus again obviating the possibility of their being injured or broken by inadvertent collision.

It also will be noted that the cylinders 38 are mounted by their bases at the upper ends of the guide tracks 32. This provides an additional advantage. Because the active stroke of the cylinders is limited by their lengths and the lengths of the rods which can be retracted within the cylinders and extented from their cylinders, where packing cylinders of this general utility are located with their bases at the lower ends of the guide tracks 32, in prior art mechanisms, the downward movement of the particular packer blade is limited by the fact that the cylinders which activate the packer blade can only retract their rods to a limited extent in the downward direction. This results in the necessity of lowering the bases of the cylinders as far as possible and thus reducing the ground clearance of the bottom of the particular tail gate and requiring it to be stronger.

Furthermore, because the packing cylinders 38 are arranged with their bases up, they can be mounted on the heavy hinge plates 28 which transfer the reactive force to the body hinge plates 27 and to the heavy body frame members 30, again reducing the required strength of the tail gate, its cost and dead weight.

Figure 9:
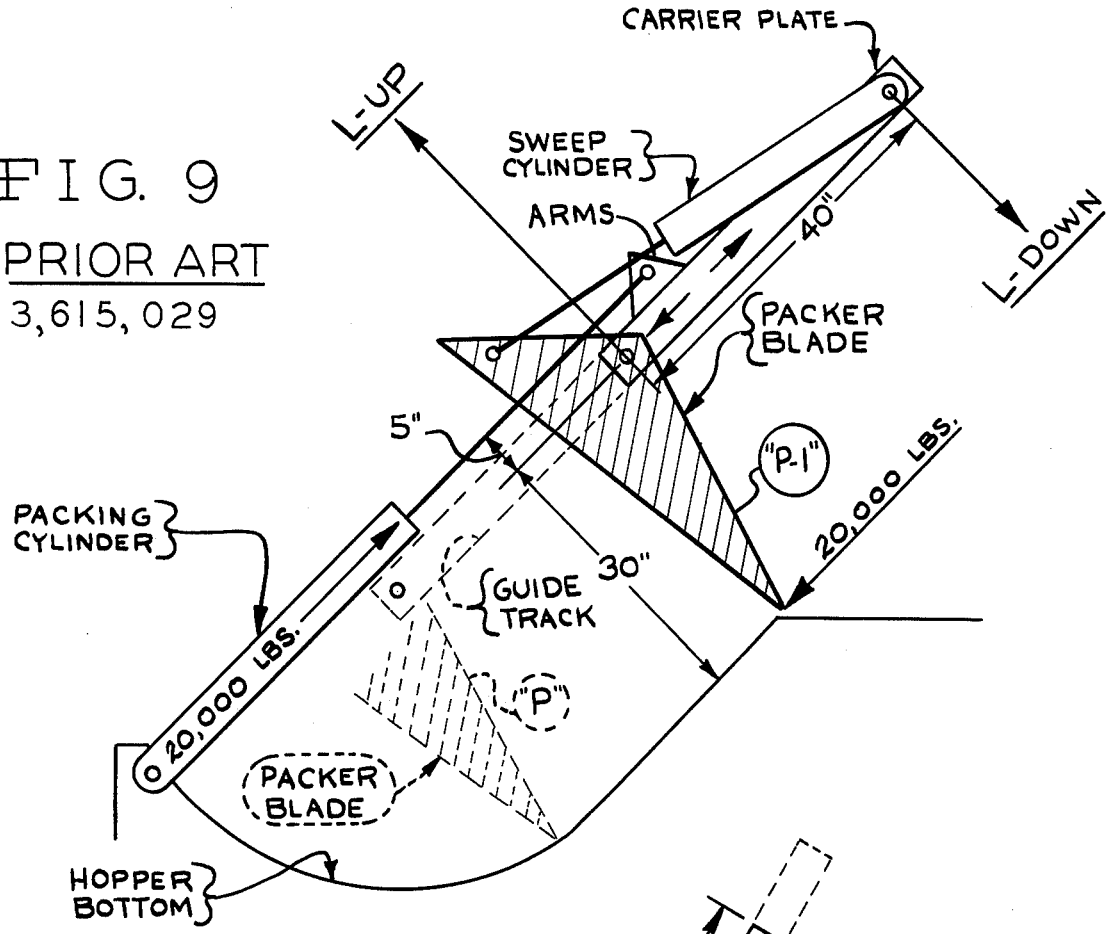
FIG. 9 PRIOR ART
FIGS. 9 and 10 are simplified diagramatic views illustrating the operation and resulting track loadings of packer blade actuating mechanisms according to the prior art identified in those figures.
Figure 10:
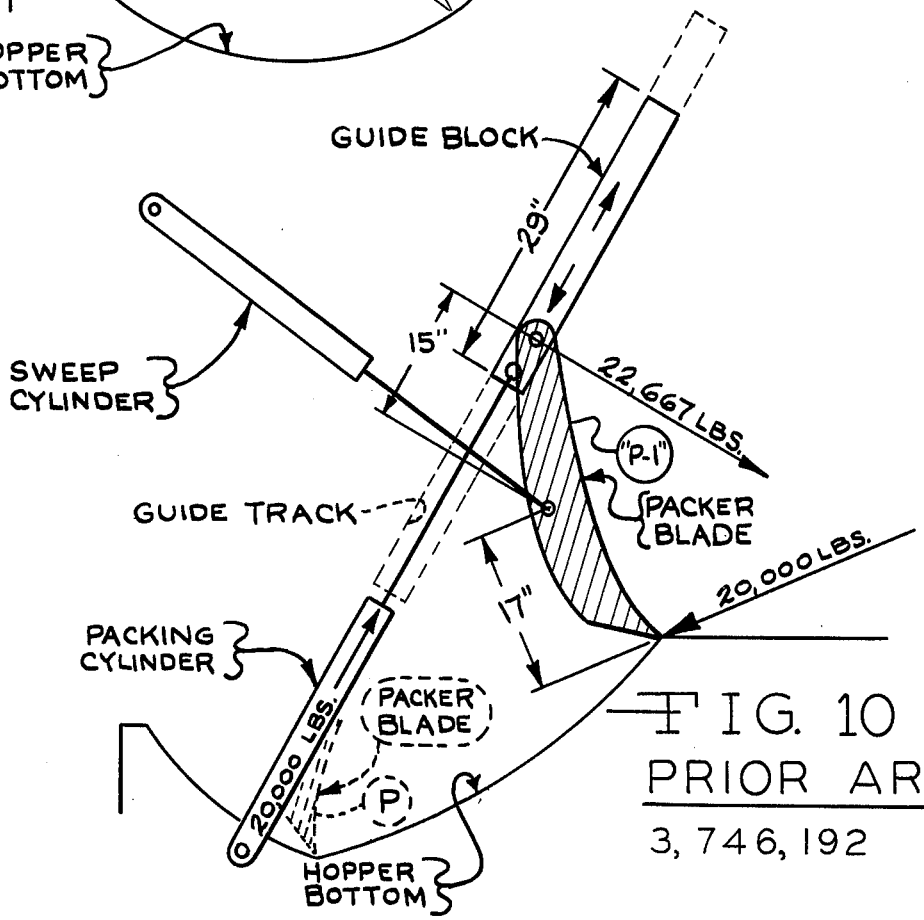
FIG. 10 PRIOR ART
Figure 11:
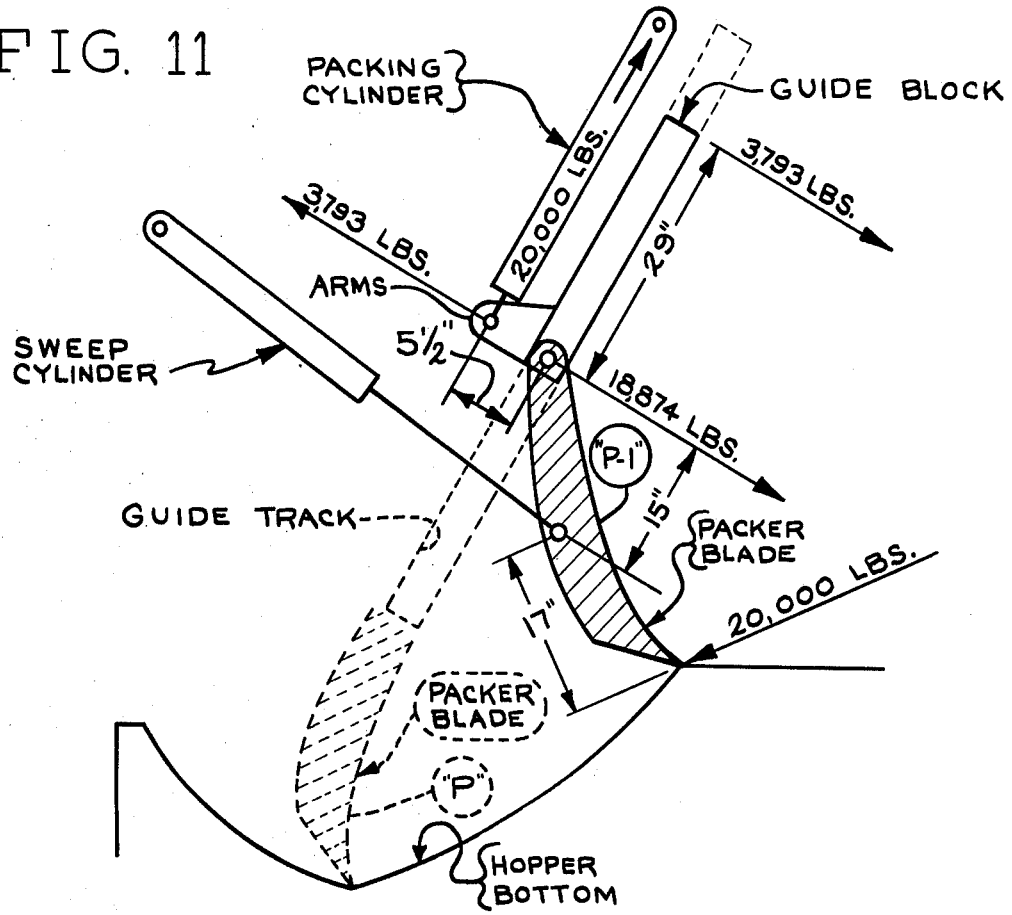
FIG. 11 is a view similar to FIGS. 9 and 10 but showing the forces involved and the resulting track loading of a mechanism embodying the invention.

However, the greatest advantage accruing from the specific mechinism as disclosed in the drawings and previously described, will be better understood by reference to FIGS. 9, 10 and 11.

FIG. 9 is a diagrammic sketch showing the structure of several prior art patents, among them those mentioned above to Appleman and Anderson which utilize carrier plates to travel back and forth in guide tracks. The carrier plates actually mount and carry the respective sweep cylinders.

In FIG. 9 a sweep cylinder is shown as being pivoted at its upper end to a carrier plate which travels back and forth in upwardly and forwardly inclined guide tracks. The carrier plate is reciprocated back and forth in the guide tracks by packing cylinders which have their bases at the lower rear portions of the tail gate hopper and which extend upwardly parallel to the guide tracks, the ends of their rods being pivotally connected to arms which are secured to the carrier plates. In this form of construction a packer blade (shown in solid lines and indicated by the legend "P-1") is pivoted at its intermediate forward portion to the lower end of the carrier plate. The upper end of the packer blade is pivotally connected to the rods of the sweep cylinders.

A cycle of operation of a packer blade mechanism as illustrated in FIG. 9 also involves the sequential and alternate operation of the sweep and packing cylinders. The position shown in solid lines in FIG. 9 is the closed or traveling position. When the control mechanism of such a device is actuated, the sweep cylinders retract their rods, swinging the packer blade in a clockwise direction around its pivot at the lower end of the carrier plate. The packing cylinders then retract their rods pulling the carrier plate and the packer blade downwardly so that its lower edge overlies the rear portion of the tail gate hopper bottom. The sweep cylinders are then actuated to extend their rods, once again moving the packer blade into the position indicated by the letter P and shown in broken lines of FIG. 9 which sweeps refuse out of the cylindrical portions of the hopper bottom and compacts it slightly against the front face of the packer blade. The packing cylinders are then actuated to again extend their rods moving the carrier plate and packer blade back up to the position shown in solid lines in FIG. 9.

Assuming that the packing cylinders exert a force of 20,000 pounds and that the resistance to the movement of the packer blade from the dotted line position in FIG. 9 to the solid line, upper position therein, is resisted by compacted refuse in equal force, the resulting load on the guide tracks is very substantial. The load caused by the refuse has also been shown by an arrow drawn to the tip of the packer blade and bearing the legend "20,000 lbs.". When the packer blade is moved from the dotted line position P to the solid line position P-1 the refuse above the blade resists this movement and causes the lower most edge of the blade to function as a fulcrum around which the force of the packing cylinders is applied.

As readily can be seen this results in a substantial up track loading by reason of the indicated 5 inch spacing of the center line of the packing cylinder rods above the center line of the guide track. At the same time the application of the force of the packing cylinders through the arms to the carrier plate creates a mechanical couple which results in producing an up track loading at the lower end of the carrier plate and a down track loading at its upper end.

With the structural geometry of a packer blade actuating mechanism of the type shown in FIG. 9 and the forces indicated thereon, moments result about the upper end of the carrier plate which balance each other in clockwise and counter-clockwise directions. The clockwise moments are the sum of the product of the packing cylinder force times the packing cylinder lever arm or $20{,}000 \times 5$ and the load of 20,000 pounds times its load lever i.e., the 30 inch distance from the tip of the packer blade to the center line of the guide track or $20{,}000 \times 30 = 600{,}000$ pounds for a total of clockwise moments of 700,000 pounds. Counter-clockwise moments are the total uptrack load times the carrier plate length of 40 inches. The uptrack load is 700,000 pounds divided by 40 or 17,500 pounds net uptrack load.

The mechanical couple resulting from the application of force from the packing cylinders to the carrier plate, which is the result of the force of 20,000 pounds acting over a lever arm of 5 inches, divided by the length of the carrier plate or 40 inches, produces an up track load of 2500 pounds at the lower end of the carrier plate and a similar down track load at the other end of the carrier plate.

The figure of considerable importance in considering a structure of this type is, of course, the net up track load of 17,500 pounds produced by the packing cylinders during the movement of the packer blade from the dotted line position P to the solid line position P-1. This is a force which tends to separate the upper and lower sides of the guide tracks so they must be very massive and it is a force which cannot be transferred from the guide track or from the tail gate to the vehicle body.

It is also important to note that the bases of the packing cylinders in the arrangement of FIG. 9 are supported only by the rear lower portions of the tail gate so that the structure of that portion of the tail gate must be quite massive in order to withstand the reaction to the exertion of 20,000 pounds thrust by the packing cylinders.

The geometry of the construction shown in FIG. 10, according to the mentioned Herpich et al patent, has some similarity to the geometry of the mechanism embodying the instant invention but also suffers from some of the faults already discussed with respect to the structure illustrated in FIG. 9.

In FIG. 10 the sweep cylinders are connected between the upper rear corners of the tail gate and the intermediate portion of the packer blade. However, as in FIG. 9, the bases of the packing cylinders are mounted in the lower rear portion of the tail gate but extend upwardly in alignment with the center lines of the guide tracks. The rods of the packing cylinders are connected to the lower ends of guide blocks which are reciprocated in the guide tracks by the packing cylinders.

Assuming the same power in the packing cylinders of 20,000 pounds and the same resistance to the movement of the packer blade from the dotted line position at the bottom of the hopper to the solid line position in FIG. 10, also of 20,000 pounds, the geometry works out to provide downtrack loading rather than up track loading as is the case in the structure of FIG. 9. Again, considering that the tip of the packer blade is the fulcrum about which the forces react, the 20,000 pound force of the packing cylinder has a lever arm of 17 inches in the illustrated construction resulting in a moment of 340,000 pounds in a clockwise direction. Because the counter-clockwise moment is equal to the clockwise moment, the counter-clockwise moment is 340,000 (clockwise moment) divided by the 15 inch lever arm between the point of connection of the sweep cylinder rods to the packer blade and the pivot point of the packer blade in the guide blocks as indicated on the sketch, or a resulting downtrack loading of 22,667 pounds at the pivot point of the packer blade in the guide blocks.

Down track loading is more desirable than the up track loading produced by the construction illustrated in FIG. 9 because a down track load can be resisted by structural members in the lower part of the tail gate which, as shown in FIG. 1 of the drawings, lies against the massive frame structures 30 of the refuse vehicle body itself.

In contrast to both of the prior art structures as illustrated in FIGS. 9 and 10 and described immediately above, the arrangement of the mechanism of the instant invention and the geometry which it establishes, results in several improvements, giving the mechanism of the instant invention a longer life and enabling a tail gate of equal capacity to be constructed from less massive materials, resulting in lower cost and substantially reduced dead weight.

Again, considering that the packing cylinders exert a force of 20,000 pounds and that their center lines extend parallel to the respective center lines of the adjacent guide track at a distance of 5-½ inches, when the rods of the packing cylinders are retracted, the tip of the packer blade again acts as a fulcrum by reason of the resistance to movement of the refuse and, again, this force is equal to 20,000 pounds. The attachment of the packing cylinders to the guide blocks at the ends of their rigid arms, i.e., at 5-½ inches away from the center lines of the guide tracks, results in a mechanical couple of approximately 3793 pounds in an up track direction at the lower end of the guide blocks and the same value in the down track direction at the upper ends of the guide blocks.

Although in the specific illustration of FIG. 11, the centerline of the packing cylinders is parallel to the centerline of the guide tracks and spaced at a distance of 5-½ inches therefrom, it will be appreciated that this is not a specific requirement and that in various constructions according to the invention, the centerlines of the packing cylinders may or may not be parallel to the centerlines of the guide tracks and the spacing there between may be more or less than 5-½ inches. In any event, if the length of the guide blocks is the same, then the up-track and down-track forces resulting from the mechanical couple are calculated by the following formula:

$$\frac{\text{Packing Cylinder Force} \times \text{Arm Length}}{\text{Guide Block Length}} = \text{Mechanical Couple Force.}$$

In the illustration of FIG. 11, this formula is:

$$\frac{20{,}000 \times 5\tfrac{1}{2}}{29} = 3{,}793 \text{ lbs.}$$

If the lengths of the arms of the guide blocks were 7 inches, the equation could be:

$$\frac{20{,}000 \times 7}{29} = 4{,}828 \text{ lbs.}$$

Because of the relationship expressed in the equation, any change in the length of the guide blocks would also change the resulting up-track and down-track loads applied by the mechanical couple.

Further considering the showing in FIG. 11, the downtrack load resulting from the resolution of the equation, taking into account the packing cylinder force and the refuse resistance, is the same as that expressed above with respect to the Herpich et al patent because the elements of cylinder force, point of connection of the sweep cylinder rods to the packer blade and moment arm between that point and the lower end of packer blade is the same in the arrangement of the instant invention as it is in the Herpich et al patent.

However, by reason of the mechanical couple just discussed, the down-track load in a mechanism according to the instant invention is reduced by the up-track effect of the couple so that the net down-track load in the arrangement in FIG. 11 is only 18,874 lbs. (22,667-3793). If the length of the arms extending upwardly and rearwardly from the guide blocks were lengthened as discussed above, and the resulting force of the mechanical couple similarly applied, then the net down-track load of a mechanism according to the invention would be reduced still further to 17,839 lbs. (22,667-4828).

The forgoing discussion explains the manner in which a packer blade actuating mechanism according to the instant invention produces an improved result over what, at first consideration, are the somewhat similar arrangements of the discussed prior art. It also can be seen that the improved concepts of the instant invention are not limited to the specific dimensions of the mechanism shown in the drawings, and particularly illustrated in FIG. 11, but that the invention can be utilized in mechanisms of different sizes and arrangements providing that the concepts expressed are carried out in the resulting geometry.

Having described our invention, we claim:

1. In a tailgate for a rear loading refuse vehicle said tailgate having parallel, spaced side walls and a hopper-like bottom, the combination of a packer blade and mechanism for actuating said packer blade comprising, a. upwardly and forwardly inclined guide tracks in said side walls, b. packer blade support means extending across said tailgate and including elements reciprocable in said guide tracks, c. a generally rectangular packer blade extending across said tailgate that is pivoted at its upper horizontal edge to said support means, d. a pair of hydraulic packing cylinders and piston rods each being pivotally mounted at its upper end near the upper end but offset rearwardly from the center line of the associated one of said guide tracks and pivotally connected at its lower end to one of said reciprocable elements, and e. a pair of hydraulic sweep cylinders and piston rods, each being pivotally mounted at the upper rear corner of said tailgate at its upper end and pivotally connected at its lower end to said packer blade at a point generally intermediate the upper and lower horizontal edges of said packer blade.

2. A tailgate according to claim 1 in which the packing cylinders have their bases pivoted near the upper ends of the guide tracks and their rods are connected to the reciprocable elements, the center lines of said cylinders and rods extending parallel to the center lines of said guide tracks.

3. A tailgate according to claim 1 in which the packer blade support means consists of an elongated slide block that is reciprocable in each of the guide tracks and a member extending across said tailgate and structurally integral with said slide blocks.

4. A tailgate according to claim 3 in which each of said slide blocks has a structurally integral mounting arm extending rearwardly away from the center line of the associated guide track and the lower end of the associated packing cylinder and piston rod is connected to said arm at a point spaced from the center line of said guide track.

5. A tailgate according to claim 4 in which each of the guide tracks has a lower surface and an upper surface and the slide blocks bear against said upper and lower surfaces when said slide blocks are reciprocated therein.

6. A tailgate according to claim 4 in which each of the mounting arms and its associated slide block constitutes a mechanical couple that applies simultaneous up and down track loading to the upper and lower sides of the respective guide track when the packing cylinders are energized to pull the slide blocks and the packer blade forwardly and upwardly for moving refuse out of the bottom of the tailgate and into a refuse vehicle.

7. In a tailgate for a refuse truck having spaced vertical side walls, a hopper-like bottom and rear opening and a generally rectangular packer blade extending across between said side walls for movement through said hopperlike bottom, the improvement comprising, in combination, a. an upwardly and forwardly extending linear guide track on the inner side of each of said side walls, b. a generally rectangular elongated slide block moveable back and forth in each of said guide tracks, c. a first hydraulic cylinder and a piston rod therefor associated with each of said guide tracks for reciprocating the respective one of said slide blocks in its guide track, d. means mounting the base of each of said cylinders interiorly of the associated one of said side walls at a point spaced upwardly and rearwardly of the upper portion of the associated one of said guide tracks, e. an arm of each of said slide blocks that extends upwardly from the lower portion thereof, f. a yoke connecting the outermost end of each of said first piston rods to the respective one of said arms, whereby said cylinder and piston rod extend at least generally parallel to the respective one of said guide tracks, g. a horizontal pivot member for said packer blade extending along the upper edge thereof and journalled in said slide blocks, h. a pair of second hydraulic cylinders and piston rods therefor, i. means mounting the bases of said second cylinders at the upper rear corner of said tailgate, j. means pivotally connecting the outermost ends of said second piston rods to said packer blade at points generally intermediate the upper and lower edges thereof, and k. control means for alternately energizing said first and second hydraulic cylinders for moving said packer blade backwardly above refuse in said hopper-like bottom, downwardly into said bottom and forwardly therethrough for moving refuse out of said bottom and into the body of said truck.

8. In a tailgate according to claim 7, an arm on each of the slide blocks extending from the center line thereof a distance such that the center line of the associated one of the first cylinder and piston rod diverges rearwardly from the center line of the associated one of said guide tracks.

9. A packer blade for a tailgate according to claim 7 in which the refuse contacting forward face thereof is generally cylindrically concave.

10. Packer blade actuating and guiding mechanism for a refuse truck tailgate, said tailgate having laterally spaced, vertical side walls, and hopper-like bottom, a rear refuse receiving opening, an upwardly and forwardly extending linear guide track in each of said side walls, packer blade support means including parts moveable back and forth along each of said guide tracks, a rectangular packer blade extending across said tailgate, a pivot means for said packer blade extending across said support means and along the upper horizontal edge of said packer blade, said mechanism comprising, in combination, a. linearly moveable power means for reciprocating said support means along said guide tracks, b. means mounting one end of each of said power means in the upper forward part of said tailgate at a point spaced upwardly and rearwardly of the upper portion of the associated one of said guide tracks, c. an arm on each of said slide blocks that extends upwardly and rearwardly from the lower portion thereof, d. a yoke connecting the lower end of each of said power means to the respective one of said arms, whereby the direction of force applied by said power means extends at least generally parallel to the respective one of said guide tracks, e. a pair of sweep cylinders and piston rods therefor, f. means mounting one end of said sweep cylinders and rods at the upper rear corner of said tailgate, and g. means pivotally connecting the other ends of said sweep cylinders and piston rods to said packer blade at points generally intermediate the upper and lower edges thereof.

11. In a tailgate for a rear loading refuse vehicle said tailgate having parallel, spaced side walls and a hopper-like bottom, and having a packer blade and a mechanism for actuating said packer blade comprising upwardly and forwardly inclined guide tracks in said side walls, packer blade support means extending across said tailgate and including elements reciprocable in said guide tracks, a generally rectangular packer blade extending across said tailgate that is pivoted at its upper horizontal edge to said support means, the improvement comprising, in combination, a. first hinge elements at the upper front corner of said tailgate and second cooperating hinge elements at the upper rear corner of the body of said vehicle, b. a pair of hydraulic packing cylinders and piston rods the bases of said cylinders being pivotally mounted on the first said elements and extending therefrom downwardly along the associated one of said guide tracks with each of said rods being pivotally connected at its lower end to said packer blade support means, and c. a pair of hydraulic sweep cylinders and piston rods, said rods being pivotally connected at their lower ends to said packer blade for swinging said packer blade angularly relative to said support means.

12. A tailgate according to claim 10 in which the guide tracks are linear.

13. A tailgate according to claim 10 in which the center lines of the packing cylinders are parallel to the guide tracks.

14. A tailgate according to claim 10 in which the packer blade support means consists of an elongated slide block reciprocable in each of the guide tracks and a cross member extending between said slide blocks on which the packer blade is pivotally mounted.

15. A tailgate according to claim 14 in which each of the slide blocks has an upwardly and rearwardly extending structurally integral arm and each of the packing cylinder rods is connected to the associated one of said arms at a point spaced upwardly from the center line of the associated guide track.

* * * * *